US007939736B2

(12) United States Patent
Campling

(10) Patent No.: US 7,939,736 B2
(45) Date of Patent: May 10, 2011

(54) ADJUSTABLE LEVER ARM CAPO

(75) Inventor: Nicholas John Campling, Cambridgeshire (GB)

(73) Assignee: C7TH Limited (GB)

( * ) Notice: Subject to any disclaimer, the term of this patent is extended or adjusted under 35 U.S.C. 154(b) by 0 days.

(21) Appl. No.: 12/641,428

(22) Filed: Dec. 18, 2009

(65) Prior Publication Data

US 2010/0154616 A1 Jun. 24, 2010

(30) Foreign Application Priority Data

Dec. 19, 2008 (GB) ..... 0823215.9

(51) Int. Cl.
*G10D 13/02* (2006.01)

(52) U.S. Cl. ..... 84/315

(58) Field of Classification Search ..... 84/312 R, 84/315–318
See application file for complete search history.

(56) References Cited

U.S. PATENT DOCUMENTS

| | | | |
|---|---|---|---|
| 360,612 | A | 4/1887 | Morstatt |
| 432,165 | A | 7/1890 | McKeever |
| 468,193 | A | 2/1892 | Dahlman et al. |
| 3,933,073 | A | 1/1976 | Hutchins |
| 4,104,947 | A | 8/1978 | Oster |
| 4,143,576 | A | 3/1979 | Nichols et al. |
| 4,149,443 | A | 4/1979 | Bringe |
| 4,250,790 | A | 2/1981 | Shubb et al. |
| 4,270,432 | A | 6/1981 | Wilkerson |
| 4,324,165 | A | 4/1982 | Wilkerson |
| 4,583,440 | A | 4/1986 | Powell, Jr. |
| 5,431,080 | A | 7/1995 | Wiesenthal |
| 5,492,045 | A | 2/1996 | Roblee |
| D372,259 | S | 7/1996 | Kyser |
| D378,825 | S | 4/1997 | Dunlop |
| 5,623,110 | A | 4/1997 | Hoglund et al. |
| 5,792,969 | A | 8/1998 | Shubb et al. |

(Continued)

FOREIGN PATENT DOCUMENTS

| | | | |
|---|---|---|---|
| EP | 1 143 408 | A2 | 10/2001 |
| WO | 98/49669 | A1 | 11/1998 |

OTHER PUBLICATIONS

Sterner—"Capos attached from the side With spring", http://web.telia.com/~u86505074/capomuseum/Side/Spring/side_spr.htm.—Nov. 4, 2009, 7 Pages.

GB Search Report—Application No. GB0823215.9, Dated Apr. 15, 2009, 1 Page.

Sterner—"Capos attached from the side With spring", http://web.telia.com/~u8650574/capomuseum/Side/Spring/side_spr.htm.—Nov. 30, 2006, 6 Pages.

(Continued)

*Primary Examiner* — Kimberly R Lockett
(74) *Attorney, Agent, or Firm* — Brooks Kushman P.C.

(57) ABSTRACT

A capo (10) for use with a stringed instrument comprises a top arm (12), lower arm (16) and a lever arm (24). The top arm (12) is adapted to extend across a fingerboard of the instrument above the strings (4), and a side arm is connected and extending at an angle to the top arm and arranged to extend generally laterally of the neck (2) of the instrument. The lower arm (18) has one end pivotally attached to the side arm (16) at a lower arm pivot (20) and is adapted to abut against the back of the neck of the instrument when in a closed position. The lever arm has one end pivotally attached to the side arm (16) at a pivot (26) spaced from the lower arm pivot (20). The capo further includes an adjuster mechanism (28, 334) that extends and projects an adjustable amount from the lever arm (24) and has an end tip (32) which bears against the lower arm (24).

22 Claims, 4 Drawing Sheets

U.S. PATENT DOCUMENTS

| | | | | |
|---|---|---|---|---|
| 6,008,441 | A | 12/1999 | Steinberger | |
| 6,459,025 | B1 * | 10/2002 | D'Addario | 84/318 |
| 6,528,711 | B1 | 3/2003 | Paige | |
| 6,635,813 | B2 | 10/2003 | Campling | |
| 6,835,880 | B1 | 12/2004 | Silva | |
| 6,965,067 | B2 | 11/2005 | Kondo | |
| D585,479 | S | 1/2009 | Campling | |
| 2004/0261600 | A1 | 12/2004 | Silva | |
| 2005/0087056 | A1 | 4/2005 | Zager, Jr. et al. | |
| 2005/0098019 | A1 | 5/2005 | Tran | |
| 2008/0168882 | A1 | 7/2008 | Campling | |

OTHER PUBLICATIONS

Picture of G7th Performance Capo.
Picture of G7th Nachville Capo.
Picture of Keyser Capo.
Picture of Victor Capo.
Picture of Dunlop C Clamp Capo.
Picture of Dunlop Capo.
Marked-up Front Page Of U.S. Patent 6,835,880.
UK Intellectual Property Office—Further Search Report Dated Nov. 9, 2010—Application No. GB0823215.9.

* cited by examiner

ADJUSTABLE LEVER ARM CAPO

CROSS-REFERENCE TO RELATED APPLICATIONS

This application claims foreign priority benefits under 35 U.S.C. §119(a)-(d) to GB 0823215.9, filed Dec. 19, 2008, which is hereby incorporated by reference in its entirety.

BACKGROUND

1. Field

The present invention relates to a capo for a stringed musical instrument, in particular to improvements to lever arm type capos.

2. Background Art

A capo, sometimes variously termed a capodastro, capodaster, capo tasto or cejilla, is a well-known device used with a stringed instrument, for example a guitar or banjo, which has a neck and a set of strings extending along the length of the neck. The capo, when applied, serves to clamp the strings against the fingerboard provided along the neck, and in particular against one of the number of fret bars disposed along the length of the fingerboard, to reduce the effective length of the strings and therefore adjust the pitch produced by the strings.

A large number of different capos, divided into different basic types exist. Each different type of capo has very different advantages and technical considerations. Players often have preferences for different types of capo. Manufacturers conventionally develop the different types of capos separately and independently in particular due to the different characteristics of the different types of capos and due to customer preferences for the different types.

One type of capo is a lever arm type positive locking capo. A commercially successful example of this type of capo is described in U.S. Pat. No. 4,250,790. This capo comprises a top arm that bears against the strings and which is connected to a side arm extending laterally of the instrument neck. Pivotally attached to the side arm are a lower arm which extends under the back of the instrument neck, and a lever arm located below the lower arm. An adjusting screw extends through the lever arm to bear against the lower surface of the lower arm when the lever member is pivoted toward the jaw member. As the lever member is pivoted toward the lower arm, the tip of the adjusting screw abuts against a rear abutment surface of the lower arm urging the lower arm towards the top arm whereby the upper surface of the lower arm engages the back of the instrument neck and the top arm depresses the strings against the fingerboard on the top of the neck. The arrangement is such that further pivoting of the lever arm is arranged to then cause the tip of the adjustment screw to move along the rear abutment surface to and beyond an over-centre point and maximum deflection of the lower arm by the tip of the adjustment arm. At that point the lever arm is then biased and urged against the lower arm and the lower arm is then locked in a closed position. The adjusting screw may be advanced or backed off to vary the extent to which the jaw member closes before over centre point and locking of the capo is reached, thereby allowing the capo to accommodate varying sizes of instrument neck, and allowing the user to regulate the pressure exerted by the capo on the instrument strings.

Despite the commercial success of the capo described in U.S. Pat. No. 4,250,790 over a number of years there are problems which have not to date, despite the time over which this capo has been available, been recognised or addressed and which have generally been overlooked. In particular this type of capo is in fact relatively difficult to apply and generally needs two hands to fit to an instrument. In addition the arms when the capo is not in use and attached to the instrument are prone to dangle and freely pivot and flap about preventing easy application to the guitar neck. Furthermore the adjuster screw and linkages are subject to various lateral and shear loads. This induces stresses within the assembly and also in relation to lateral loads on the adjuster screw increase the friction on the threads making adjustment more difficult. The operation can also be improved, in particular to provide improved locking and prevent 'drop off' resistance. In particular the disposition of the adjusting screw relative to the lower arm leads to differential "drop off" across the operating range of the capo. Indeed an improvement to this capo to address this problem is described in U.S. Pat. No. 5,792,969 and WO9849669, and another similar arrangement is described in US 2005/0087056. The overall appearance of the capo can also be improved.

Other examples of lever arm capos are also described in U.S. Pat. No. 360,612; U.S. Pat. No. 468,193; U.S. Pat. No. 4,149,443; U.S. Pat. No. 4,104,947, and US 2008/0168882. U.S. Pat. No. 360,612, U.S. Pat. No. 468,193, and U.S. Pat. No. 4,149,443 which again date back over a number of years do not include suitable adjustment arrangements to accommodate different sizes of neck while achieving positive locking. In relation to U.S. Pat. No. 468,193 and US 2008/0168882 locking is in particular achieved by a spring load such that it is not positively locked and the locking and load is less than ideal such that the strings may not be sufficiently clamped to give a crisp note, and/or the capo may become dislodged.

Such lever type capos, in particular an adjustable lever arm type capo can therefore be further improved.

SUMMARY

It is therefore desirable to provide an improved adjustable lever arm type capo which addresses at least some of the above described problems and/or which more generally offers improvements or an alternative to existing arrangements.

According to the present invention there is therefore provided a capo as described in the accompanying claims.

In an embodiment of a first aspect of the invention there is provided a capo for use with a stringed instrument having a neck having a fingerboard and a back, and a plurality of strings that extends longitudinally over said fingerboard. The capo comprises a top arm, a lower arm, a lever arm, and an adjuster mechanism. The top arm is adapted to extend across the fingerboard above the strings, and a side arm is connected and extends at an angle to the top arm and is arranged to extend generally laterally of the neck. The lower arm has one end pivotally attached to the side arm at a lower arm pivot and is adapted in use to abut against the back of said neck of the instrument when in a closed position. The lever arm has one end pivotally attached to the side arm at a pivot spaced from the pivotal attachment of the lower arm. The adjuster mechanism extends and projects an adjustable amount from the lever arm and has an end portion which bears against the lower arm. The adjuster mechanism is mounted to and pivotable with the lever arm. A biasing arrangement biases the lower arm away from the top arm and towards an open position.

This arrangement ensures that the lower arm and so capo, is held open making fitting of the capo easier. It also restricts movement of the lower arm to prevent tangling when not in use and fitted to the neck.

Preferably a line of action of the adjuster mechanism along which the end portion which bears against the lower arm is moveable passes through the pivot axis of the pivotal attachment of the lever arm to the side arm. Alternatively the adjuster mechanism is laterally spaced from lever arm pivot.

In an embodiment of a second aspect of the invention there is provided a capo for use with a stringed instrument having a neck having a fingerboard and a back, and a plurality of strings that extends longitudinally over said fingerboard. The capo comprises a top arm, a lower arm, a lever arm, and an adjuster mechanism. The top arm is adapted to extend across the fingerboard above the strings, and a side arm is connected and extends at an angle to the top arm and is arranged to extend generally laterally of the neck. The lower arm has one end pivotally attached to the side arm at a lower arm pivot and is adapted in use to abut against the back of said neck of the instrument when in a closed position. The lever arm has one end pivotally attached to the side arm at a pivot spaced from the pivotal attachment of the lower arm. The adjuster mechanism extends and projects an adjustable amount from the lever arm and has an end portion which bears against the lower arm. The adjuster mechanism is mounted to and pivotable with the lever arm with the line of action of the adjuster mechanism extending through the pivotal attachment of the lever arm to the side arm. More specifically and preferably the adjuster mechanism may extend through the lever arm pivot.

With the line of action of the adjuster mechanism extending through the pivotal attachment of the lever arm to the side arm the lateral loads on the adjuster mechanism are reduced and stresses with the lever arm and capo are reduced. In addition such an arrangement provides a more compact and integrated assembly.

A biasing arrangement may preferably bias the lower arm away from the top arm and towards an open position. In particular preferably the biasing means, more preferably comprising a spring acting on the lower arm, biases the lever arm towards the lower arm. The spring may act between the lower arm and lever arm and/or may comprise a spring (preferably a torsion spring) acting between the lower arm and the side frame.

The lever arm has a bottom wall and upstanding side walls defining a recess or channel within which the lower arm is receivable. This encloses the lower arm and protects it.

A stop may be provided that limits pivoting of lever arm.

The lever arm pivot is preferably spaced further from the top arm than lower arm pivot.

The adjuster mechanism may comprise an adjuster element having a screw threaded portion received in a threaded bore. The adjuster element is preferably keyed into a bore to allow axial movement of the adjuster element but rotationally fix the adjuster element within the bore. The threaded bore is most preferably defined in a rotatable threaded bore element which is axially fixedly fixed to the lever arm, and preferably received in a corresponding bore in the lever arm. The bore may comprise a stepped bore and the threaded bore element may have a shoulder that abuts the stepped bore in the lever arm to axially retain the threaded bore element. The bore in the lever arm may have a surrounding boss upon which a knob is mounted to rotate the threaded element.

Preferably the lever arm pivot comprises pivot rod having cross bore perpendicular to the axis of the pivot rod and to receive adjustment screw element. Alternatively the adjuster mechanism comprises an adjuster element having a screw threaded portion received in a threaded bore in the lever arm.

BRIEF DESCRIPTION OF THE DRAWINGS

The present invention will now be described by way of example only with reference to the following figures in which.

DETAILED DESCRIPTION

Figure 2:
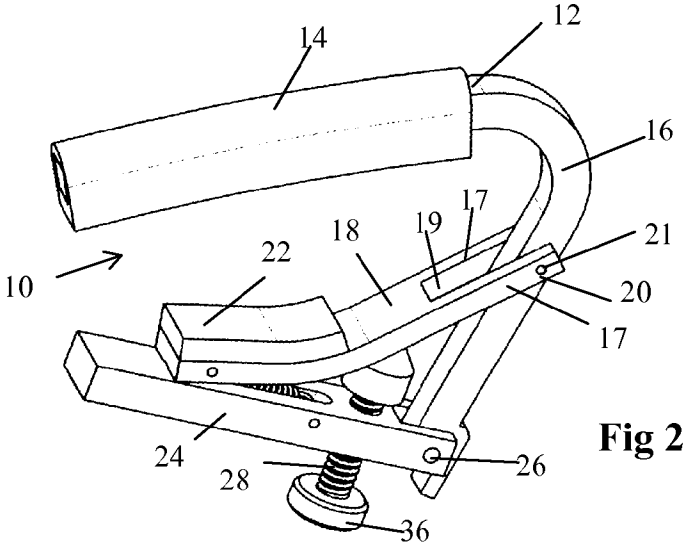
FIG. 2 is a perspective illustration of the first embodiment of the capo as shown in FIG. 1, but with the capo in a closed position.

In the following description of the invention, certain terminology will be used for the purpose of reference only, and are not intended to be limiting. Terms such as "upper", "lower", "above", "below", "rightward", "leftward", "clockwise", and "counter clockwise" refer to directions in the drawings to which reference is made. Terms such as "inward" and "outward" refer to directions toward and away from, respectively, the geometric centre of the component described. Terms such as "front", "rear", "side", "left side", "right side", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

Figure 3:
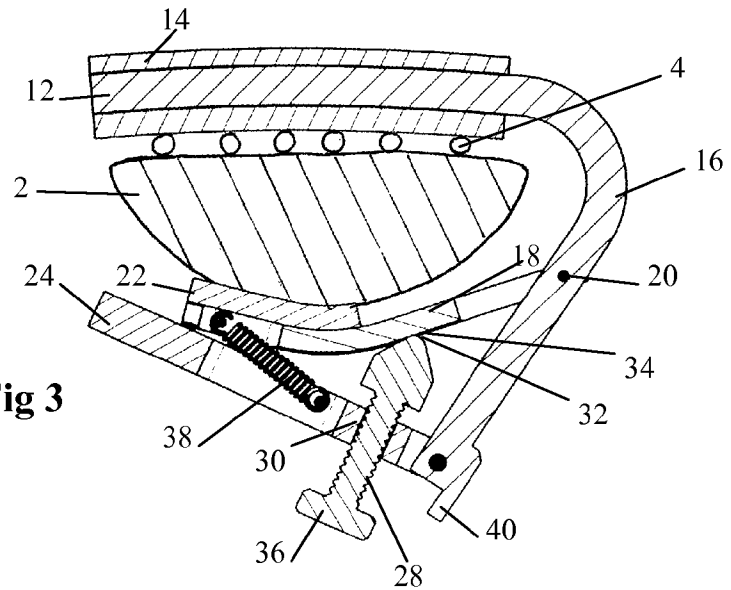
FIG. 3 is a cross sectional view of the capo shown in FIG. 2 and in the closed position.
Figure 1:
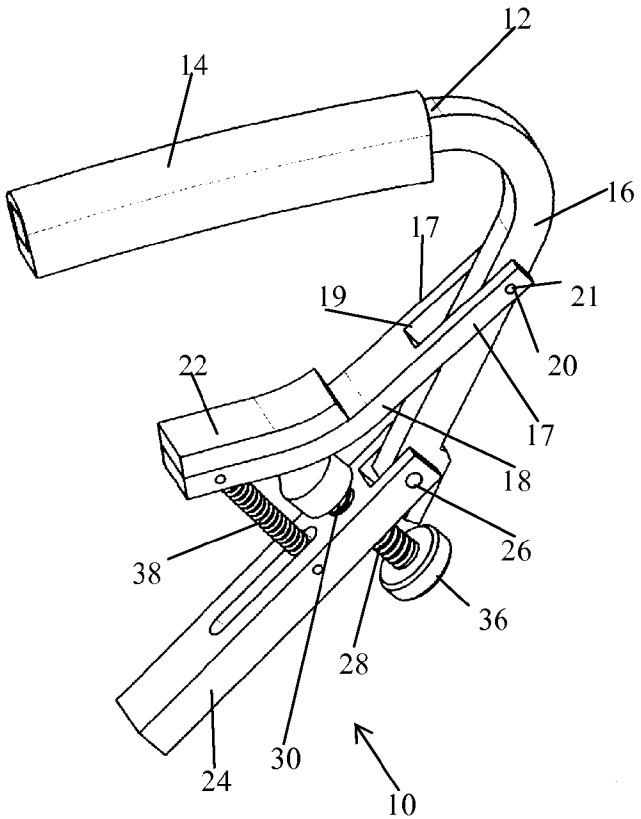
FIG. 1 is a perspective illustration of a capo according to a first embodiment with the capo in an open position.

Referring to FIGS. 1 to 3, a capo 10 according to a first embodiment comprises a top string engaging arm 12 that in use is arranged to extend across a neck 2 of an instrument, over and abutting against strings 4 of the instrument to, when closed, clamp the strings 4 against the neck 2. The top arm 12 preferably includes a resilient rubber or similar pad on its lower string engaging surface, and in this embodiment comprises a sleeve 14 fitted to the top arm 12 to cushion its engagement with the strings. A side arm 16 configured to fit in use laterally of neck 2 of the instrument extends from, and in this embodiment is integrally connected to one end of the top arm 12. A lower arm 18 is pivotally connected to side arm 16 by a pivot 20 located part way along the side arm 16 and at a position between the distal end of side arm 16 and the end of the side arm 16 connected to top arm 12. The lower arm 18 is configured such that in use it extends behind back of the neck 2 and is curved to generally fit the curve of the back of the neck 2. A topside of lower arm 18 preferably carries a resilient pad or cushion 22 for engaging the back of the neck. The end of the lower arm 18 connected to the side arm 16 preferably comprises two side prongs 17 define a slot 19 there between which is sized to receive the side arm. The pivot pin 20 pass though bores 21 in the side prongs 17 to thereby pivotally connect the lower arm 18 to the side arm 16.

A lever arm 24 is pivotally connected to the side arm 16 by a pivot 26 at a position spaced from, and in this embodiment below the connection of lower arm 18 and near the distal of side arm 18. The side arm 16 includes an end stop flange 40 extending and projecting from the distal end of the side arm adjacent to the lever arm pivot 26. This end stop flange 40 is arranged to abut against the lever arm 24 and prevent and limit further rotation of the lever arm 24 beyond a fully open position of the lever arm 24 and so capo 10. This restricts movement of the lever arm 24 beyond what is needed so preventing flapping of the arms 18, 24. It will be appreciated that other stop arrangements could be used to limit rotation of the lever arm 24. For example a stop flange 40 could be provided on the lever arm 24 rather than on the side arm 16. In addition, movement of the lower arm 18 is restricted by abutment of the end of the slot 19 with the side arm 16. By connecting the lower arm 18 and lever arm 24 by a spring 38, as will be further described below, movement of the lever arm 24 is in effect also restricted by such a restriction of movement of the lower arm 18.

An adjuster screw 28 projects and extends from the lever arm 18 and thereby pivots with the lever arm 18. In this embodiment the adjusting screw 28 is received in a threaded bore 30 spaced from the lever arm pivot 26 part way along the lever arm 24. The adjusting screw 28 has a tip 32 at its distal end that is arranged to abut and bear against a lower surface 34 of the lower arm 18 when the lever member 24 is pivoted toward the lower arm 18. Rotation of the adjuster screw 28 by a knob 36 on the other end of the screw 28 withdraws or advances the tip 32 of the screw 28 to vary the distance the tip 32 of the adjuster screw 28 extends and projects from the lever arm 24.

In use the capo 10 in an open configuration (as shown in FIG. 1) is fitted onto the neck 2 of the instrument with the top arm 12 sitting above and generally transversely of strings 18 and the lower arm 18 positioned below the back of neck 13. Once the capo 10 is at the desired position along neck 2, the lever arm 24 is pivoted upwardly toward top arm 12. As the lever arm 24 is pivoted toward the lower arm 18, the tip 32 of the adjuster screw 28 swings through an arc, the radius of which may be changed by rotating the adjuster screw 28. The tip 32 abuts against a rear abutment surface 34 of the lower arm 18 urging the lower arm 18 towards the top arm 12 whereby the lower arm 18 and pad 22 engages the back of the instrument neck 2 and the top arm 12 depresses the strings 6 against the fingerboard on the topside of the neck 2. The arrangement and arcuate movement of the tip 32 is such that further pivoting of the lever arm 24 is arranged to then cause the tip 32 of the adjuster screw 28 to move along the rear abutment surface 34 to and beyond an over-centre point and maximum deflection of the lower arm 18 toward the top arm 12 by the tip 32 and lever arm 24. At that point the lever arm 24 is then biased and urged toward and against the lower arm 18 such that the lower arm 18 is then locked in a closed position when abutting against the neck 2. The lever arm 24 in its closed/locked position (FIG. 3) extends at an upward incline relative to top arm 12 below the lower arm 18. The adjuster screw 28 may be advanced or backed off to vary the extent to which the lower arm 18 closes before over-centre point and locking of the capo 10 is reached. This allows the capo 10 to accommodate varying sizes of instrument neck 2, and allows the user to regulate the pressure exerted by the capo 10 on the instrument strings 6.

The capo 10 further includes in this embodiment a coil tension spring 38 connected and acting between the lower arm 18 and lever arm 24. The spring 38 is preferably arranged, and has a natural unextended length, such that in all positions of the lower 18 and lever 24 arms and of the adjuster screw 28, it is extended and under tension. The spring 38 thereby connects the lower arm 18 to the lever arm 24 such that the lower arm 18 moves with the lever arm 24. In particular the spring 38 provides a biasing load on the lower arm 18 biasing and urging the lower arm 18 towards the lever arm 24, and to an open position, when the lever arm 24 is opened and moved to an open position. This makes fitting the capo 10 to the neck 2 much easier with the lower arm 18 being held open by the spring 38, and by attachment to the lever arm 24 such that moving the lever arm 24 also simultaneously moves the lower arm 18 to the open position. Its also reduces relative movement of the two arms 18, 24 preventing them from flapping. The spring 38 also when the capo 10 is closed, and in a closed position (FIG. 3) similarly, and synergistically biases and holds the lever arm 24 against and towards the lower arm 18. This keeps the lever arm 24 in the closed position and keeps the capo 10 locked on the neck 2 of the instrument preventing and reducing 'drop-off'. This means that a significant load is needed to move the lever arm 24 to unlock and release the capo 10 so reducing the risk of accidental release. In addition the spring 38 holds and clamps the lever arm 24 and the tip 32 of the adjuster screw 28 in abutment with the lower arm 18. This holds the assembly together and also reduces undesirable rattling and flapping between these components when fitted to the neck 2. The load on the adjuster screw 28 provided by the spring 38 urging the lower arm 18 against the tip 32 also helps to maintain the set position of the adjuster screw 28. The addition of this spring 38, and bias load therefore provides a number of significant advantages in a simple and effective manner.

Figure 5:
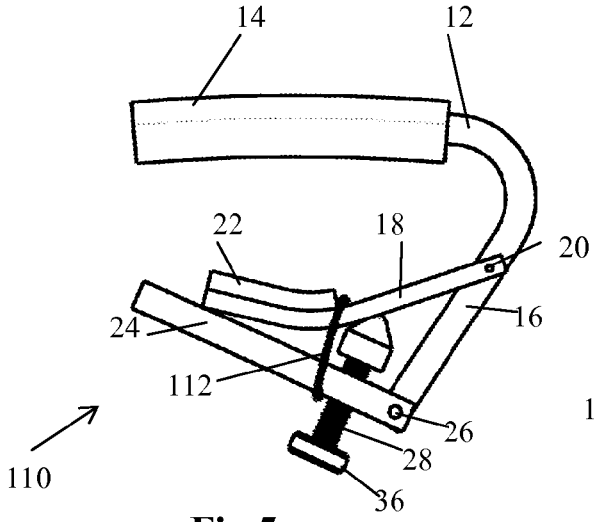
FIG. 5 is a side view of the capo shown in FIG. 4.
Figure 6:
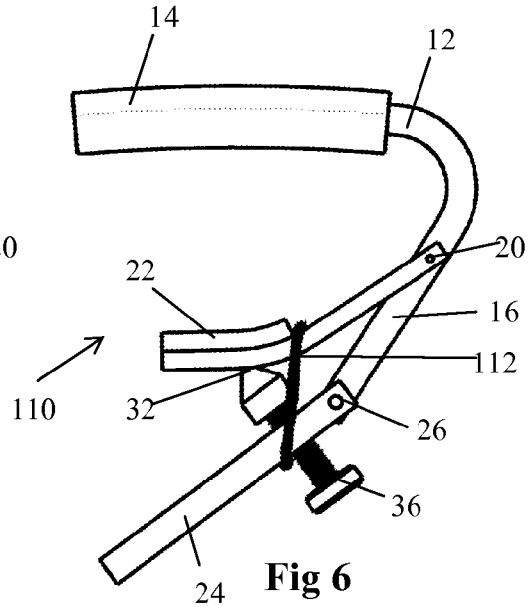
FIG. 6 is a side view of the capo shown in FIG. 4, but with the capo in an open position.
Figure 4:
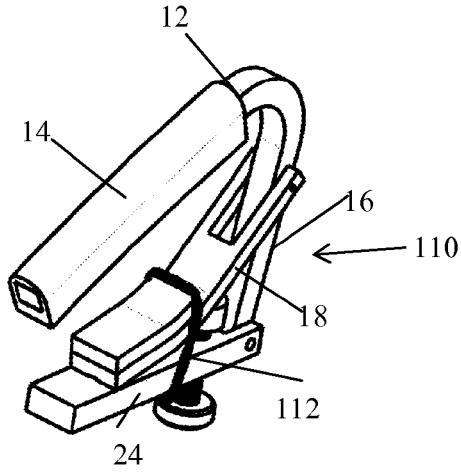
FIG. 4 is a perspective illustration of a capo according to a second embodiment and in a closed position.

It will be appreciated that the spring 38 can be replaced with other suitable resilient biasing arrangements in other embodiments to achieve the same or similar biasing functionality, and specifically biasing the lower arm 18 to the open position, and furthermore in the preferred arrangement biasing the lower 18 and lever arms 24 together. In particular FIGS. 4 to 6 show a capo 110 according to a second embodiment. This is the same as the first embodiment with like reference numerals for the same features, and will therefore not be described in detail. In this embodiment however the spring 38 is replaced with a resilient, preferably rubber or elastic, band 112 between the lower 18 and lever 24 arms.

Figure 9:
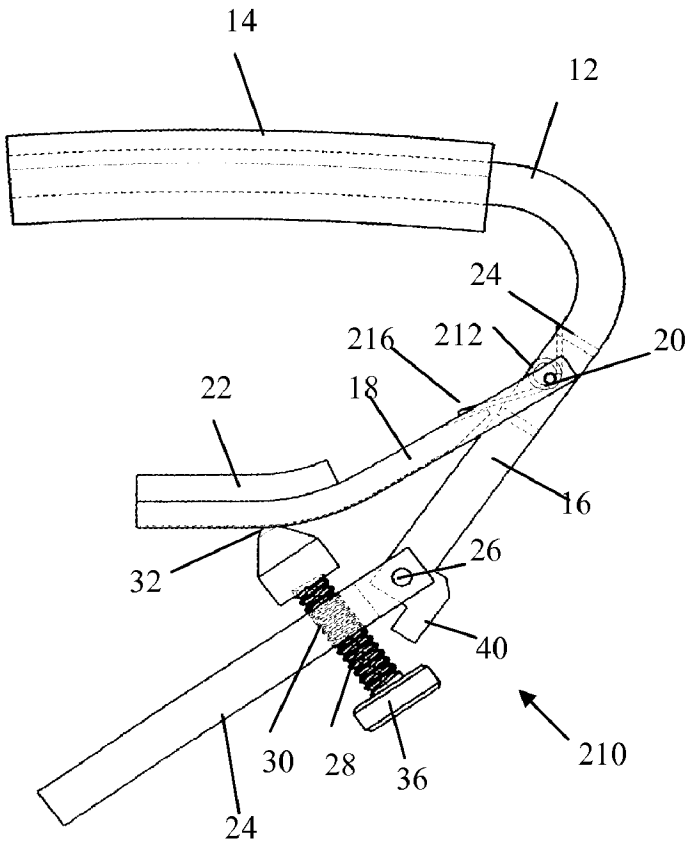
FIG. 9 is a side view of the capo shown in FIG. 7.
Figure 8:
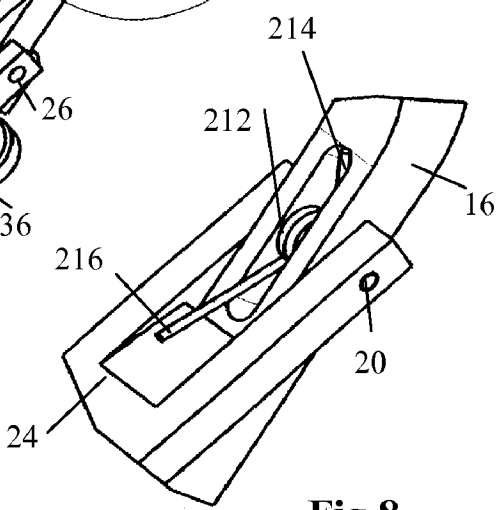
FIG. 8 is a more detailed view of the pivotal mounting of the lower arm to the side arm of the capo shown in FIG. 7.
Figure 7:
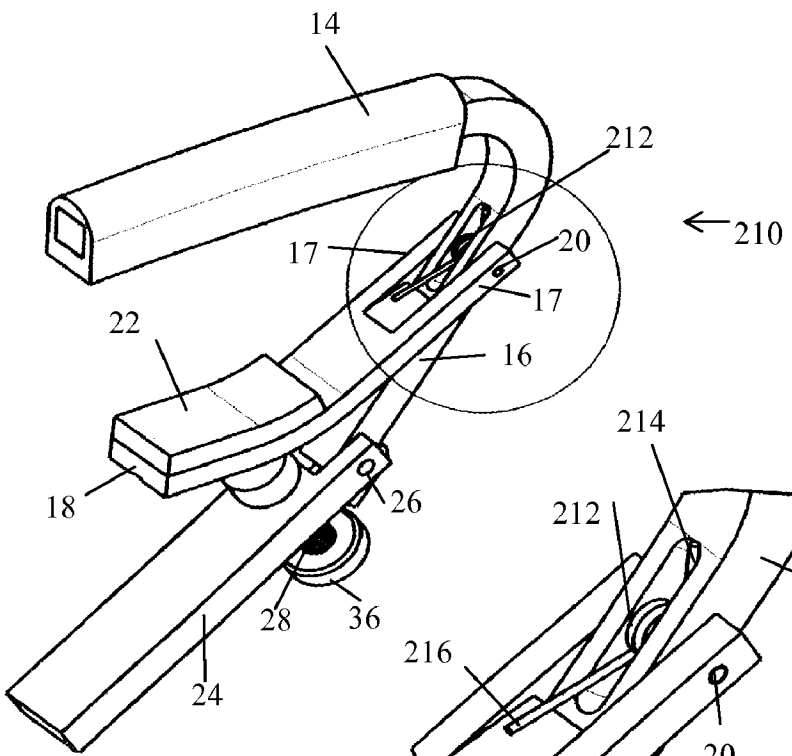
FIG. 7 is a perspective illustration of a capo according to a third embodiment and in a part open position.

FIGS. 7 to 9 show a capo according to a third embodiment. This again is similar to the first and second embodiments and like reference numerals are used for the same features, and only the main differences will now therefore be described in detail. In this capo 210 the spring between the lower 18 and lever 24 arms is omitted. Instead a torsion spring 212 is mounted around the lower arm pivot 20, having end arms 214, 216 that abut against the lower arm 18 and side arm 16 as shown more clearly in FIG. 8. This torsion spring 212 is thereby arranged to act between the lower 18 and side 16 arms and so top arm 12 to bias and urge the lower 18 arm away from top arm 12 and towards an open position as shown in FIG. 7. As such, and summarily to the other embodiments the torsion spring 212 biases the lower arm 18 open making fitting the capo 210 easier with the capo 210 and lower arm 18 being closed against the biasing force of the torsion spring 212. The torsion spring 212 also similarly urges the lower arm 18 against the lever arm 24 and into abutment with the tip 32 of the adjuster screw 28. As a result the lever arm 24 is also urged towards an open position and maintained in this open position, and preferably against the end stop flange 40 by the torsion spring 212 force. The lower 18 and lever 24 arms therefore move together reducing relative movement of the two arms 18, 24 preventing them flapping. In a closed position the torsion spring 212 similarly also keeps the lower and lever arms 18, 24 urged against each other and so the capo 210 locked reducing drop-off. It will be appreciated that the torsion spring 212 could be replaced with other similar spring and biasing arrangements.

Figure 10:
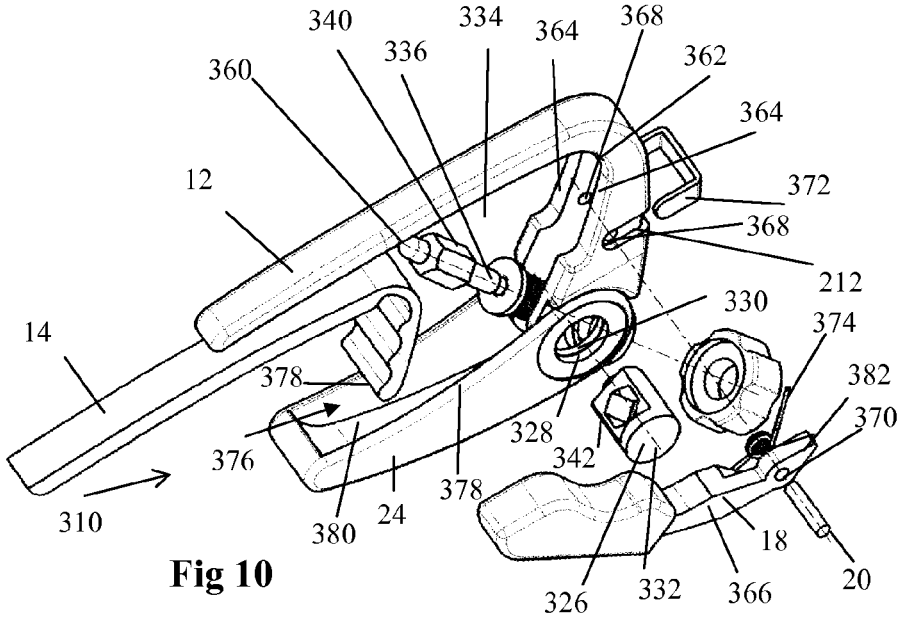
FIG. 10 is an exploded perspective illustration of a capo according to a fourth embodiment.
Figure 11:
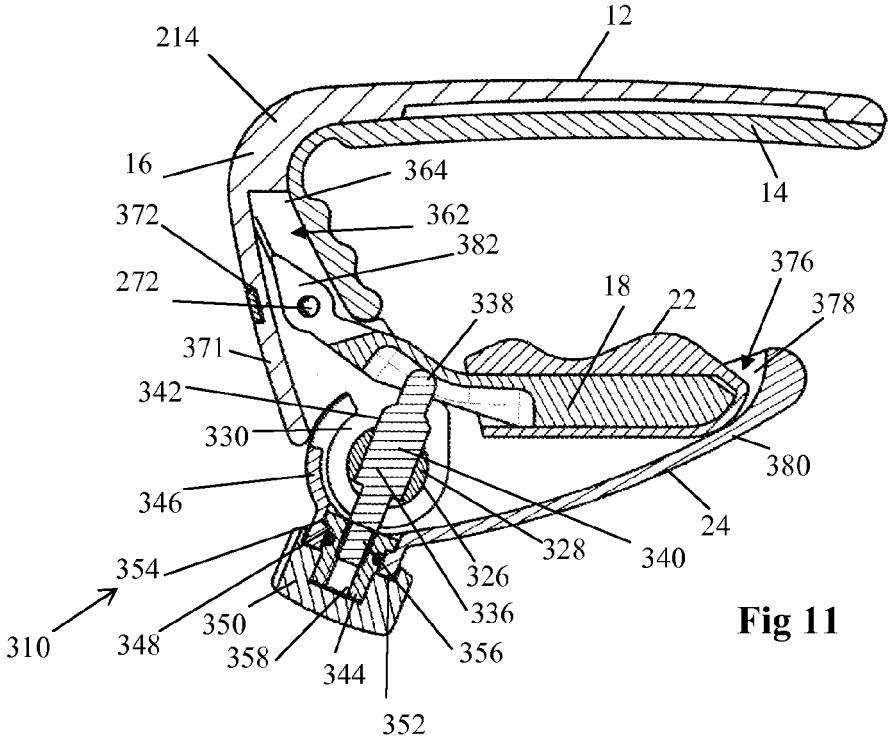
FIG. 11 is a cross sectional view of the capo shown in FIG. 10, assembled and in a closed position.

FIGS. 10 and 11 show a capo 310 according to a fourth embodiment. This, although looking somewhat different is similar to the third embodiment and includes a torsion spring 212 acting between and biasing the lower arm 18 away from the top arm 12 and to abut against the lever arm 24. Like reference numerals will therefore be used for the same features, and only the main differences will now therefore be described in detail. In particular in this embodiment the adjuster screw is replaced with an adjustment screw assembly 334, which is located such that it, and in particular its line of action and axis extends through the lever arm pivot 326 as will be described further below.

The lever arm 24 is pivotally connected to the side arm 16 of the capo 310 by a pivot pin 326 which extends through corresponding bores 330, 328 defined at the end of the side arm 16 and lever arm 24 such that the lever arm 24 pivots relative to the side arm 16 about the pivot 326 and pivot axis 332.

The adjustment screw assembly 334 comprises elongate adjuster rod 336 having a tip 338 at one end which abuts against the lower arm 18. A central section 340 of the rod 336 has a hexagonal cross section which is received, and keyed within a corresponding hexagonal cross bore 342 within the pivot pin 326 and extends perpendicular to the axis of pivot pin 326 and pivot axis 332 of the lever arm 24. The adjuster rod 336 is thereby rotationally fixed within the cross bore 342 of the pivot 326 but is free to move axially perpendicularly to the axis 332 of the pivot 326. It will be appreciated that the central section 340 of the adjuster rod 336 and cross bore may be keyed in other ways and may have other corresponding engaging profiles. A nut element 344 having a peripheral shoulder rim 346 at one inner end is rotatably mounted within a corresponding stepped bore 348 in the lever arm 24. A knurled knob 350 is fixed onto the opposite end of the nut element 344 to rotate the nut element 344. The knob 350 has a recess 352 concentric with the axis of the nut element 344 and knob 350 which when the knob 350 is fitted abuts against a circular boss 354 on the lever arm 24 concentric with the stepped bore 348 of the lever arm 24 and nut element 344. The nut element 344 is thereby rotatable within the bore 348 by the knob 350, but is axially fixed in position by engagement of the shoulder rim 346 within the stepped bore 348 and by the knob 350. The opposite end of the adjuster rod 336, opposite to the tip 338, has a threaded section 356 which is received in a threaded bore 358 in the nut element 344 to retain the adjuster rod 336. The adjuster rod 336 and its axis 360 is thereby fixed relative to the lever arm 24 and pivots about the lever arm pivot axis 332 with the lever arm 24. In addition as the adjuster rod 336 is rotationally fixed, as the nut element 344 is rotated by the knob 350 by a user the threaded end 356 of the adjuster rod 336 moves axially within the nut element 344 and the adjuster rod 336 and tip 338 withdraws or advances varying the distance the tip 338 of the adjustment screw assembly 334 extends and projects from the lever arm 24.

By locating the adjustment screw assembly 334 such that its line of action and axis 360 extends through the lever arm pivot axis 332, the lateral loading on the adjustment screw assembly 334 and lever arm 24 is reduced, and overall stresses are reduced. In particular reducing lateral loads on the adjust mechanism makes rotation of the adjustment mechanism easier. In addition this arrangement provides a neater, more compact and integrated combined arrangement and also simplifies the component since a separate additional bore does not need to be machined into the lever arm 24. As such this arrangement with the adjustment screw assembly 334 acting through the lever arm pivot 326 and in particular pivot axis 332 is particularly advantageous. The particular adjustment screw assembly 334 with the screw threaded portion 356 located within the nut element 344 and enclosed by the knob 350 protects the adjustment screw assembly 334, enclosing the threads and also avoids any movable parts of the adjustment screw assembly 334 protruding beyond the outer periphery of the capo 310 where they may become snagged.

As shown in FIGS. 10 and 11 the side arm 16 in this embodiment includes a hollow recess 362 open inwardly towards the neck 2 of the instrument and defined by opposite side walls 364. The end 366 of the lower arm 18 has a width sized to fit within the recess 362 and between the side walls 364. A pair of aligned bores 368 are defined in the side walls 364. The end 366 of the lever arm 18 has a similar bore 370 which is aligned with bores 368 in the side walls 364 to receive a cylindrical pivot pin 20 which is fitted through these bores 368, 370 with the ends of the pivot pin 20 retained in the side wall bores 368 to thereby pivotably attach the lower arm 18 to the side arm 16. As shown a U shaped cover element 372 may be provided and clipped around the outside of the side arm 16 within a corresponding channel 374 in the side arm 16 to enclose and close off the ends of the side wall bores 368 and retain the pivot pin 20.

The lever arm 24 similarly in this embodiment includes a hollow recess 376 open inwardly towards the neck 3 of the instrument and lower arm 18, and defined by opposite side walls 378 connected together by a bottom wall 380. The side walls 378 are spaced apart so as to receive the end of the side arm 16 which is fitted between them and within the recess 376. The side walls 378 include aligned bores 328 which receive the ends of the lever arm pivot pin 326, and the side wall 364 of the side arm 16 include corresponding bores 330 to receive the pivot pin 326 and thereby pivotally connect the lever arm 24 to the side arm 16 about the lever arm pivot axis 332. The recess 376 in the lever arm 24 is also sized to receive the lower arm 18 with the side walls 378 enclosing and located adjacent to the sides of the lower arm 18, and the lower arm 18 closing off the open top of the recess 376. The lower arm 18 as in the other embodiments abuts against the lever arm 24, and is biased against the lever arm by the spring 212, but in this case the lower arm 18 abuts against the bottom wall 380 of the lever arm 24 and within the lever arm recess 376. The adjustment mechanism and lever arm pivot 326 are also located within the recess 376. The lower arm 18 and adjustment mechanism 334 are thereby safely received and enclosed and so protected within and by the lever arm recess 376.

As also shown in this embodiment the pad 14 on the underside of the top arm 12 also extends part way along the side arm 16. This closes of the recess 362 in the side arm 16 and also cushions abutment of the side arm 16 against the lateral side of the neck 2 when fitted to the instrument so protecting the instrument from damage from the capo 310. It will be appreciated that this feature could readily be incorporated into the other embodiments.

The end boss 354 within which the nut element 344 is fitted is also arranged to abut an edge of an end wall 371 of the side arm 16 to thereby provide a limit stop for rotation of the lever arm 24, similar to the end flange arrangement of the other embodiments. The end 382 of the lower arm 18 may also project beyond the lower arm pivot defining a tail section a distal end of which abuts against the bottom wall 371 of the side arm recess 362 and/or side arm extension of the top pad 14 (or in other embodiments against the underside of a front wall of the side arm 16 closing off the front of the recess 362) to limit pivoting of the lower arm to a required restricted operation range.

These various embodiments and features thereof all provide an improved capo arrangement. It will however be appreciated that there are many possible modifications and variations and in particular the features of the various embodiments may be variously used in the other embodiments. For example the alternate spring arrangements connecting the lower arm 18 and lever arm 24 of the first embodiment (FIGS. 1 to 3) could be used in the fourth embodiment in addition to or instead of the torsion spring arrangement. The adjustment mechanism of the fourth embodiment could also be used in place of the adjuster screw in the other described embodiments and/or mounted in a bore in the lever arm 24 rather than in the lever arm 24 pivot pin 326.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A capo for use with a stringed instrument including a neck having a fingerboard and a back, and a plurality of strings that extends longitudinally over the fingerboard, the capo comprising:

a top arm adapted to extend across the fingerboard above the strings;

a side arm connected and extending at an angle to the top arm and arranged to extend generally laterally of the neck;

a lower arm having one end pivotally attached to the side arm at a lower arm pivot and adapted in use to abut against the back of the neck of the instrument when in a closed position;

a lever arm having one end pivotally attached to the side arm at a lever arm pivot spaced from the lower arm pivot;

an adjuster mechanism that extends an adjustable amount from the lever arm and having an end portion which bears against the lower arm, the adjuster mechanism being mounted to and pivotable with the lever arm; and a biasing arrangement biasing the lower arm away from the top arm and towards an open position.

2. The capo of claim 1 wherein a line of action of the adjuster mechanism along which the end portion which bears against the lower arm is moveable passes through a pivot axis of the lever arm pivot.

3. A capo for use with a stringed instrument including a neck having a fingerboard and a back, and a plurality of strings that extend longitudinally over the fingerboard, the capo comprising:

a top arm adapted to extend across the fingerboard above the strings;

a side arm connected and extending at an angle to the top arm and arranged to extend generally laterally of the neck;

a lower arm having one end pivotally attached to the side arm at a lower arm pivot and adapted in use to abut against the back of the neck of the instrument when in a closed position;

a lever arm having one end pivotally attached to the side arm at a lever arm pivot spaced from the lower arm pivot; and an adjuster mechanism that projects an adjustable amount from the lever arm and having an end portion which bears against the lower arm, the adjuster mechanism being mounted to and pivotable with the lever arm, wherein the adjuster mechanism has a line of action of that extends through the lever arm pivot.

4. The capo of claim 3 further comprising a biasing arrangement biasing the lower arm away from the top arm and towards an open position.

5. The capo of claim 3 further comprising a spring acting on the lower arm.

6. The capo of claim 5 wherein the spring acts between the lower arm and the lever arm.

7. The capo of claim 3 further comprising a spring acting between the lower arm and the side arm.

8. The capo of claim 7 wherein the spring comprises a torsion spring.

9. The capo of claim 3 further comprising a biasing member biasing the lever arm towards the lower arm.

10. The capo of claim 3 wherein the lever arm has a bottom wall and upstanding side walls defining a recess channel within which the lower arm is receivable.

11. The capo of claim 3 further comprising a stop that limits pivoting of the lever arm.

12. The capo of claim 3 wherein the lever arm pivot is spaced further from the top arm than the lower arm pivot.

13. The capo of claim 3 wherein the adjuster mechanism comprises an adjuster element having a screw threaded portion received in a threaded bore.

14. The capo of claim 13 wherein the adjuster element is keyed into a mounting bore to allow axial movement of the adjuster element but rotationally fix the adjuster element within the mounting bore.

15. The capo of claim 13 further comprising a rotatable threaded bore element that is axially fixed with respect to the lever arm, wherein the threaded bore element defines the threaded bore.

16. The capo of claim 15 wherein the lever arm has a bore that receives the threaded bore element.

17. The capo of claim 16 wherein the bore is a stepped bore and the threaded bore element has a shoulder that abuts the stepped bore in the lever arm to axially retain the threaded bore element.

18. The capo of claim 16 wherein the lever arm has a boss that surrounds the bore, and the adjuster mechanism further comprises a knob mounted on the boss and configured to rotate the threaded bore element.

19. The capo of claim 13 wherein the lever arm pivot comprises a pivot rod having an axis and a cross bore perpendicular to the axis and that receives the adjuster element.

20. The capo of claim 3 wherein the adjuster mechanism extends through the lever arm pivot.

21. The capo of claim 1 wherein the adjuster mechanism is laterally spaced from the lever arm pivot.

22. The capo of claim 21 wherein the lever arm has a threaded bore, and the adjuster mechanism comprises an adjuster element having a screw threaded portion received in the threaded bore.

* * * * *